US008166573B1

(12) United States Patent
Chung et al.

(10) Patent No.: US 8,166,573 B1
(45) Date of Patent: May 1, 2012

(54) HELMET SYSTEM WITH INTERCHANGEABLE OUTER SHELLS

(76) Inventors: Kirk Chung, Agoura Hills, CA (US); Matthew Chung, Agoura Hills, CA (US)

( * ) Notice: Subject to any disclaimer, the term of this patent is extended or adjusted under 35 U.S.C. 154(b) by 0 days.

(21) Appl. No.: 13/271,514

(22) Filed: Oct. 12, 2011

(51) Int. Cl.
*A42B 3/00* (2006.01)
*A63B 71/10* (2006.01)

(52) U.S. Cl. ..... 2/411; 2/425

(58) Field of Classification Search ..... 2/410, 411, 2/420, 424, 425, 421
See application file for complete search history.

(56) References Cited

U.S. PATENT DOCUMENTS 3,935,044 A * 1/1976 Daly ..... 156/79
4,307,471 A * 12/1981 Lovell ..... 2/411
4,996,724 A * 3/1991 Dextrase ..... 2/411
6,983,488 B2 * 1/2006 Foote et al. ..... 2/10
7,003,317 B2 2/2006 Belcher et al.
7,121,676 B1 * 10/2006 Kutnyak ..... 362/105
7,328,462 B1 * 2/2008 Straus ..... 2/411
7,421,744 B1 9/2008 Farrell
7,901,104 B2 3/2011 McLean et al.
7,908,667 B2 * 3/2011 Rogers et al. ..... 2/6.2
8,015,324 B2 * 9/2011 Klotz et al. ..... 710/33

* cited by examiner

*Primary Examiner* — Gloria Hale
(74) *Attorney, Agent, or Firm* — IPLA P.A.; James E. Bame

(57) ABSTRACT

A helmet system comprises a base shell, a set of outer shells, said each outer shell selectively and adjustably geared for placement on and over the base shell in an interchangeable mode and position thereon as desired by the wearer, a connector detachably engaging said each outer shell to the base shell, and a first guide rail slot that includes an upwardly extending portion that the outer shell lies on and in, so that the upwardly extending portion extends between the base and the outer shell to form a buffer there between.

20 Claims, 4 Drawing Sheets

HELMET SYSTEM WITH INTERCHANGEABLE OUTER SHELLS

BACKGROUND OF THE INVENTION

This invention relates to a helmet system having an interchangeable outer shell mechanism, more particularly to an improved helmet system with interchangeable outer shells that can be selectively worn over a base helmet without losing helmet safety factors while satisfying a user's design preferences, esthetic desires, fashion codes or other personalized tastes.

The market witnesses the ever changing tastes of helmet users. A recent trend seems to incorporate additional functions to an existing helmet. For example, U.S. Pat. No. 7,901,104 discloses a helmet shell having one or more light emitting diodes that receives an electric current from batteries to improve recognition on the street. U.S. Pat. No. 7,421,744 discloses a helmet with an acoustic voice chamber integrated within the helmet to allow the motorcycle driver to easily communicate with a rider seated behind the driver.

Prior art also shows incorporation of a communication device to a helmet. U.S. Pat. No. 7,003,317 discloses a helmet with a communication cable with internal wire connections to allow cellular phones to operate on a motorcycle riding.

An increasing demand on the market is to introduce a helmet that satisfies a user's changing tastes in esthetic desires, color coordination and fashion codes with all safety factors maintained and improved. Motorcycle owners want to change designs whenever they like or replace damaged shells without having to purchase a new helmet that will ever need to them, barring serious damage.

SUMMARY OF THE INVENTION

The present invention is contrived to overcome the conventional disadvantages. Accordingly, an objective of the present invention is to provide a helmet system with interchangeable outer covers that can be selectively worn over a base helmet without losing helmet safety factors, thus satisfying a user's changing tastes.

Another objective is to provide a helmet system with interchangeable outer covers, enabling a user to maximize his or her design preferences, esthetic desires, fashion codes or other personalized tastes.

A still another objective is to provide a helmet system with interchangeable outer covers, visually satisfying motorbike riders, mountain bikers, skate boarders, horseback riders, roller skaters, and other recreational and professional activities requiring head protection.

In order to achieve these and other objectives, the present invention provides a helmet system comprising, a base shell; a set of outer shells, said each outer shell selectively geared on and over the base shell to a user's taste in an interchangeable mode; a connection means detachably engaging said each outer shell to the base shell; and a first guide rail formed on the base shell to serve as a buffer between the base and outer shells.

The connection means is formed such that said each outer shell is detachably snap-hooked to the base shell in rear of the helmet system. Alternately, the connection means may be formed such that said each outer shell is detachably hole-bump engaged to the base shell in front of the helmet system.

The detachable hole-bump engagement is elastic to enable a bump-push release to detach the selected outer shell from the base shell. The set of outer shells are color matched to look different from each other. The set of outer shells are formed of one selected from polycarbonate, Kevlar, fiberglass and carbon fiber. The outer shell covers at least three quarters (¾) the base shell when worn over the base shell.

The helmet system may further comprise a second guide rail substantially parallel to the first guide rail when viewed atop, in a front to real orientation of the base shell.

A support rail may be provided having a groove and formed along a rim of the base shell, wherein the selected outer shell fits in the groove when worn on and over the base shell.

In an embodiment, a helmet system according to the present invention comprises a base shell; a set of outer shells, said each outer shell selectively geared on and over the base shell to a user's taste in an interchangeable mode; a connection means detachably engaging said each outer shell to the base shell; a guide rail formed on the base shell to serve as a buffer between the base and outer shells; a visor detachably attached to the base shell.

Preferably, the visor is attached through the outer shell to the base shell by a bump-hole mechanism to provide an additional engagement of the selected outer shell to the base shell.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Referring to the accompanying drawings, the present invention will now be explained. A helmet system 10 according to the present invention is to introduce an interchangeable outer shell mechanism meeting an esthetic desire, a fashion code and a design satisfaction to motorbike riders, mountain bikers, skate boarders, horseback riders, roller skaters, and other recreational and professional activities requiring head protection.

Figure 1:
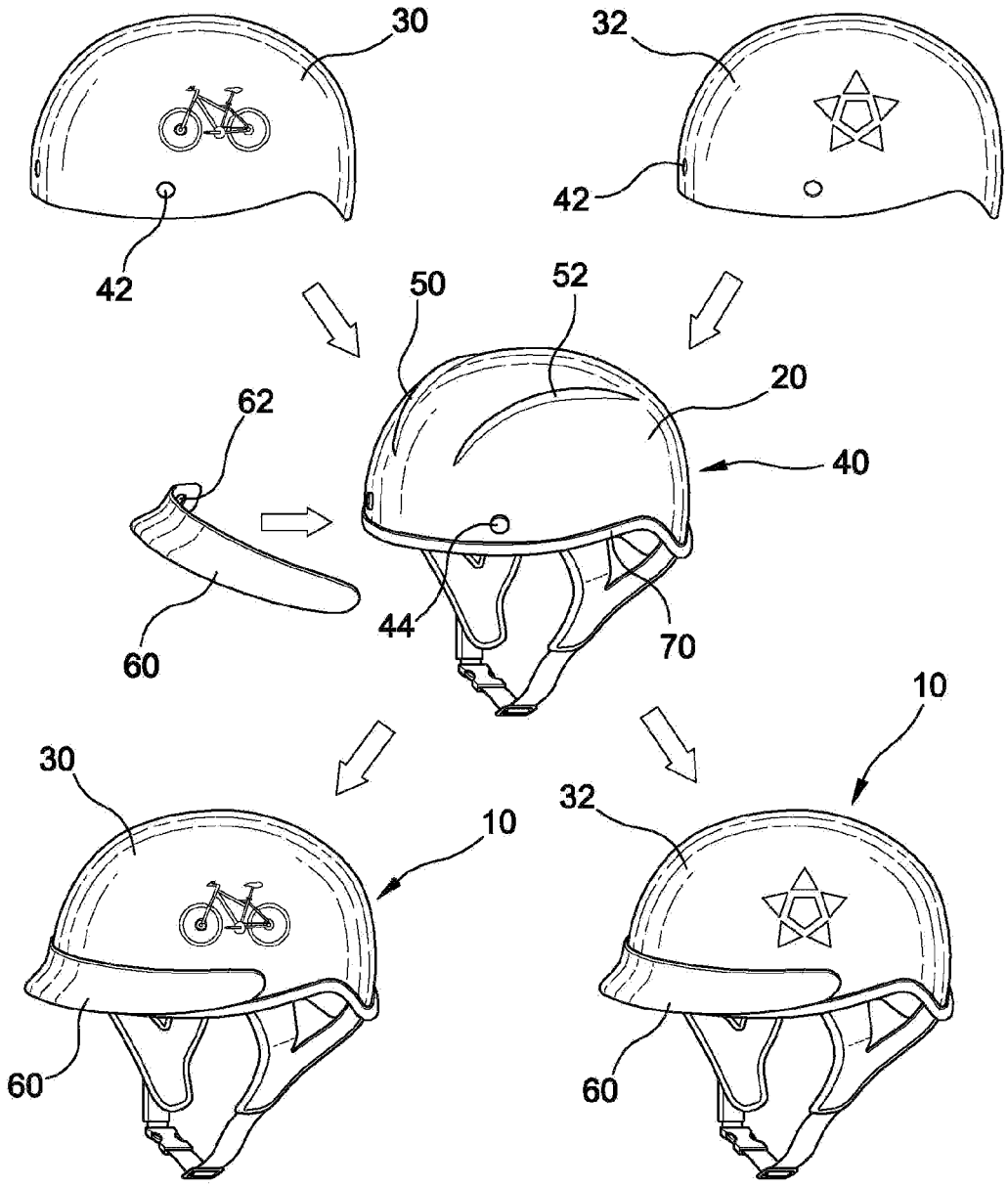
FIG. 1 is a view showing a interchangeable mechanism of outer shells in a helmet system according to the present invention.
Figure 2:
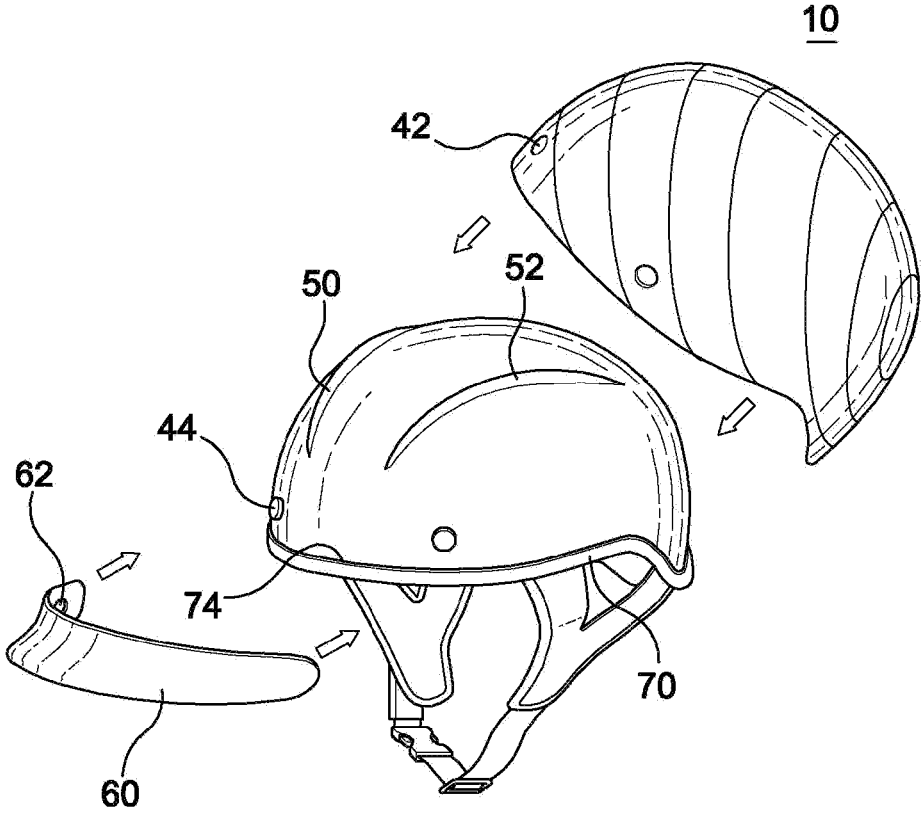
FIG. 2 is an exploded view showing assembly of the helmet system according to the present invention.
Figure 3:
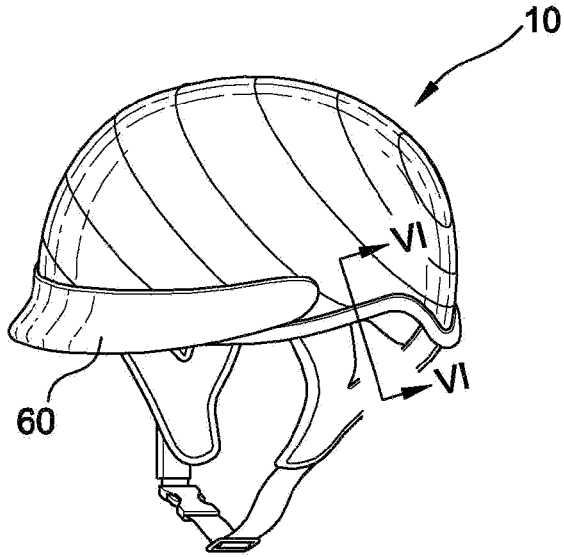
FIG. 3 is a view showing an assembly according to the present invention.
Figure 4:
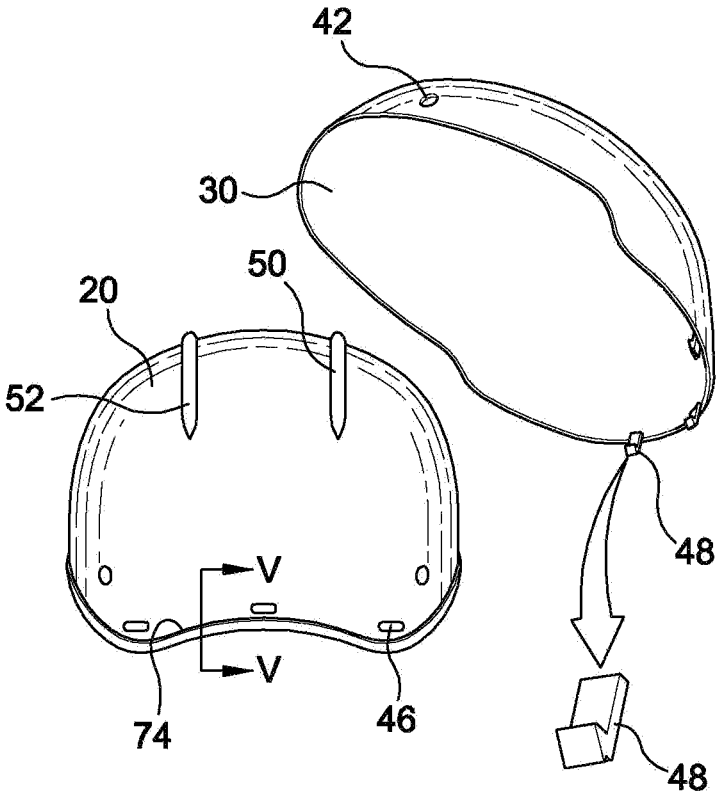
FIG. 4 is a view showing an assembly mechanism according to the present invention.
Figure 5:
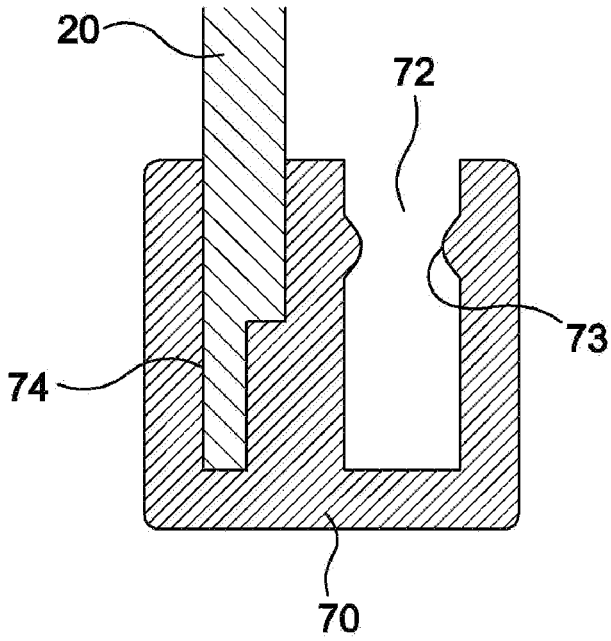
FIG. 5 is a cross-sectional view taken along V-V in FIG. 4.
Figure 6:
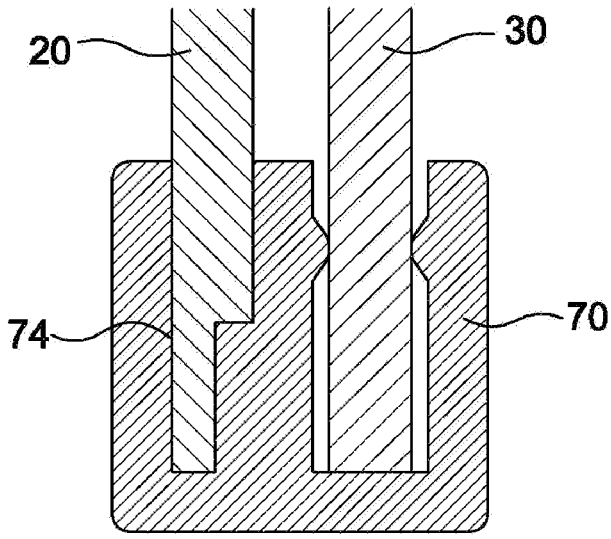
FIG. 6 is a cross-sectional view taken along VI-VI in FIG. 4.

As shown in FIG. 1, the helmet system 10 comprises a base shell 20, a set of outer shells 30, 32 and connection means 40, first and second guides 50, 52, and a visor 60. Each of the outer shells 30, 32 are detachably engaged to the base shell 20 by the connection means 40 which includes outer shell holes 42, base shell bumps 44, base shell rear holes 46, and outer shell snap hooks 48. Thus, the connection means 40 serves to detachably engage each outer shell 30 to the base shell 20 with an improved security.

The set of outer shells 30, 32 are selected and geared on and over the base shell 20 to a user's taste in an interchangeable mode. The helmet system 10 applies to a half helmet or an open-faced helmet. The base shell 20 may irreparably have a polystyrene foam therein and connected to a standard strap.

For a better performance, first and second guide rails 50, 52 are formed on the base shell 20 to serve as a buffer between the base and outer shells 20, 30. The guide rails 50, 52 may further serve as an air buffer between the base and outer shells 20, 30 to solidify the helmet structure and system and provide a better cushion at an unexpected accident and hit. In a preferred version, the second guide rail 52 is formed substantially parallel to the first guide rail 50 when viewed atop, in a front to real orientation of the base shell 20.

The connection means 40 is formed such that each outer shell 30, 32 is detachably snap-hooked to the base shell 20 in rear of the helmet system 10. Alternately, the connection means 40 may be formed such that each outer shell 30, 32 is detachably hole-bump engaged to the base shell 20 in front of the helmet system 10. In specific, when the selected outer shell 30 is worn over the base shell 20, the bumps 44 is snapped in the holes 42 in front of the helmet system 10 whereas the hooks 48 of the outer shell 30 become detachably hooked in the holes 46 in rear of the helmet system 10.

The detachable hole-bump engagement may be formed elastic to enable a bump-push release to detach the selected outer shell 30 from the base shell 20 where the bumps 44 are pushed up to remove the outer shell 30.

In a preferred version, the rear side of the outer shell 30 may be first pushed down onto a rear side of the base shell 20 to get hooked in by the rear hook-hole mechanism, which is then followed by a pushdown of the outer shell 30 onto the corresponding front side of the base shell 20.

A plurality of outer shells with a variety of different colors may be formed into a predetermined set of outer shells with color match to look different from each other. The set of outer shells may be formed of one selected from polycarbonate, Kevlar, fiberglass and carbon fiber.

The outer shell 30 may cover the whole part of the base shell. It is recommended that outer shell 30 cover at least three quarters (¾) the base shell when worn over the base shell 20.

The helmet system 10 may further comprise a support rail 70 having a groove 72 and formed along a rim 74 of the base shell 20, wherein the selected outer shell 30 fits in the groove 72 when worn on and over the base shell 20. Here, the support rail 70 is fixed to the base shell 20. In a preferred version, a protrusion 73 are formed on each inner side of the groove 72 to provide an additional safety grip to the outer shell 30.

In an embodiment, the visor 60 is attached through the outer shell 30 to the base shell 20 by a bump-hole mechanism to provide an additional engagement of the selected outer shell 30 to the base shell 20. In specific, the outer shell 30 is attached or worn on and over the base shell 20 and thereafter the visor 60 is detachably engaged to the inner shell 20 with the outer shell 30 squeezed between the visor 60 and the base shell 20. For example, a receptor 62 inwardly formed on each side of the visor 60 may receive therein the corresponding base shell bump 44 through the outer shell hole 42.

The helmet system 10 may keep most of the basic structural design of a half helmet or an open-faced helmet, but instead of a standard single shell, the system 10 provides two or more separate shells. The division of the standard shell into two separate shells is what makes this unique to standard motorcycle helmets. The base shell can be attached to the polystyrene foam as if a shell is on a standard helmet, but the outer shell is free standing. Individually, the shells are thinner than a standard shell, but together they are of standard thickness that meets regulations/standards (ex. USA FMVSS 218). The shells can be made of polycarbonate plastic or composite material (Kevlar, fiberglass, carbon fiber, etc).

Aside from the two-part shell, the other unique parts to this helmet system are the snap system of the shells, the guiding grooves on the base shell, and the two-slot rubber beading. The snap system keeps the outer shell securely attached to the base shell. The posterior and interior of the base shell have notches (female) and the outer shell has corresponding protruding snaps (male). When the outer shell is placed over the base shell, the male snaps of the outer shell locks into the notches of the inner shell to secure the shells together. In order to guide the outer shell, the base shell has grooves that make it easy for the snaps to slide into place and to prevent damage to the base shell. The two-slot rubber beading along the helmet allows for two shells instead of the standard single slot rubber beading.

For helmets with attachable visors, the base shell and the outer shell have holes for the visor to be screwed in to the helmet. The outer shell locks into the base shell normally and then the visor is screwed in to the helmet afterwards.

The concept of a two-part shell helmet could work with many other systems designed to attach the outer shell to the base shell. A screw system using screws to attach the two shells would be a viable option for secure attachment. Just as a visor is attached to a helmet, the shells would have holes that allows for a screw. Clip systems could attach the shells together using the concept of a clip on the base shell that swings over the outer shell to lock the two together. A variety of other notch systems such as indentions instead of incisions or differing notch placements could also be used. A slot system where a protruding disks or similar male part on the outer shell slides into slots on the base shell could be used. This helmet system employs simple, unique concepts to dynamically change the static, standard motorcycle helmet.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A helmet system, comprising:

a base shell;

a set of outer shells, said each outer shell selectively and adjustably geared for placement on and over the base shell in an interchangeable mode and position thereon as desired by the wearer;

a connection means detachably engaging said each outer shell to the base shell; and a first guide rail slot that includes an upwardly extending portion that the outer shell lies on and in, and wherein the upwardly extending portion extends between the base shell and the outer shell to form a buffer there between.

2. The helmet system of claim 1, wherein the connection means is formed such that said each outer shell is detachably snap-hooked to the base shell in rear of the helmet system.

3. The helmet system of claim 1, wherein the connection means is formed such that said each outer shell is detachably hole-bump engaged to the base shell in front of the helmet system.

4. The helmet system of claim 3, wherein the detachable hole-bump engagement is elastic to enable a bump-push release to detach the selected outer shell from the base shell.

5. The helmet system of claim 1, wherein the set of outer shells include different colors that coordinate with each other and are included on the outer shell in different combinations to provide different helmet color combinations that are coordinated.

6. The helmet system of claim 1, wherein the set of outer shells are formed of one selected from polycarbonate, Kevlar, fiberglass and carbon fiber.

7. The helmet system of claim 1, wherein the outer shell covers at least three quarters (¾) the base shell when worn over the base shell.

8. The helmet system of claim 1, further comprising a second guide rail substantially parallel to the first guide rail when viewed atop, in a front to real orientation of the base shell.

9. The helmet system of claim 1, further comprising a support rail having a groove and formed along a rim of the base shell, wherein the selected outer shell fits in the groove when worn on and over the base shell.

10. A helmet system, comprising:

a base shell;

a set of outer shells, said each outer shell selectively and adjustably geared for placement on and over the base shell in an interchangeable mode and position thereon as desired by the wearer;

a connection means detachably engaging said each outer shell to the base shell;

a first guide rail slot that includes an upwardly extending portion that the outer shell lies on and in, and wherein the upwardly extending portion extends between the base shell and the outer shell to form a buffer there between; and a visor detachably attached to the base shell.

11. The helmet system of claim 10, wherein the connection means is formed such that said each outer shell is detachably snap-hooked to the base shell in rear of the helmet system.

12. The helmet system of claim 10, wherein connection means is formed such that said each outer shell is detachably hole-bump engaged to the base shell in front of the helmet system.

13. The helmet system of claim 12, wherein detachable hole-bump engagement is elastic to enable a bump-push release to detach the selected outer shell from the base shell.

14. The helmet system of claim 10, wherein the set of outer shells include different colors that coordinate with each other and are included on the outer shell in different combinations to provide different helmet color combinations that are coordinated.

15. The helmet system of claim 10, wherein set of outer shells are formed of one selected from polycarbonate, Kevlar, fiberglass and carbon fiber.

16. The helmet system of claim 10, wherein outer shell covers at least three quarters (¾) the base shell when worn over the base shell.

17. The helmet system of claim 10, further comprising a second guide rail substantially parallel to the first guide rail when viewed atop, in a front to real orientation of the base shell.

18. The helmet system of claim 10, further comprising a support rail having a groove and formed along a rim of the base shell, wherein the selected outer shell fits in the groove when worn on and over the base shell.

19. The helmet system of claim 18, wherein the support rail is fixed to the base shell.

20. The helmet system of claim 10, wherein the visor is attached through the outer shell to the base shell by a bump-hole mechanism to provide an additional engagement of the selected outer shell to the base shell.

* * * * *